US008707490B1

(12) United States Patent
Pelton

(10) Patent No.: US 8,707,490 B1
(45) **Date of Patent: *Apr. 29, 2014**

(54) SURVIVAL KNIFE WITH INTEGRATED TOOLS

(75) Inventor: Robert Young Pelton, Bonsall, CA (US)

(73) Assignee: DPX Ventures Limited, Ras Al Khaimah (AE)

( * ) Notice: Subject to any disclaimer, the term of this patent is extended or adjusted under 35 U.S.C. 154(b) by 269 days.

This patent is subject to a terminal disclaimer.

(21) Appl. No.: 13/400,535

(22) Filed: Feb. 20, 2012

Related U.S. Application Data

(63) Continuation-in-part of application No. 13/312,965, filed on Dec. 6, 2011.

(51) Int. Cl.
*B26B 11/00* (2006.01)
*B26B 3/00* (2006.01)
*B25F 1/00* (2006.01)

(52) U.S. Cl.
CPC ..... *B26B 11/00* (2013.01); *B26B 11/006* (2013.01); *B26B 3/00* (2013.01); *B25F 1/00* (2013.01)
USPC ..... 7/156; 7/158; 30/123; 30/142

(58) Field of Classification Search
CPC ..... B26B 11/00; B26B 11/006; B26B 3/06; B25F 1/00
USPC ..... 7/118, 144, 151, 156, 158, 165; 30/123, 30/340, 342–344, 351, 357, 127, 136, 142
See application file for complete search history.

(56) References Cited

U.S. PATENT DOCUMENTS

| | | | | |
|---|---|---|---|---|
| 1,455,621 | A | 5/1923 | Joyner | |
| 2,315,898 | A | 4/1943 | Krilow | |
| D141,321 | S | 5/1945 | Gallagher | |
| 2,440,485 | A | 4/1948 | Ranseen | |
| D169,490 | S | 5/1953 | Hug | |
| D169,797 | S | 6/1953 | Wallace | |
| 2,951,482 | A | 9/1960 | Sullivan | |
| D224,388 | S | 7/1972 | Wood | |
| 3,760,438 | A | 9/1973 | White | |
| D230,696 | S | 3/1974 | Evrell et al. | |
| D245,830 | S | 9/1977 | De Gross | |
| 4,363,147 | A | 12/1982 | Deweese | |
| 4,442,559 | A * | 4/1984 | Collins | 7/158 |
| 4,553,279 | A | 11/1985 | Gassew et al. | |
| 4,578,864 | A | 4/1986 | Hoffman | |

(Continued)

FOREIGN PATENT DOCUMENTS

| | | | |
|---|---|---|---|
| DE | 10130178 | A1 | 1/2003 |
| DE | 202009001850 | U1 | 12/2009 |

OTHER PUBLICATIONS

Extended European Patent Search, dated Mar. 15, 2013, 5 pages.

(Continued)

*Primary Examiner* — David B Thomas
(74) *Attorney, Agent, or Firm* — Arc IP Law, PC; Joseph J. Mayo

(57) ABSTRACT

Survival knife that includes structural elements to implement any combination of a bottle opener/pan holder feature, wire breaker/choil, jimping/wire strippers, hex nut driver/lashing point, pry bar/scraper, glass breaker in a single blade configuration.

28 Claims, 11 Drawing Sheets

(56) References Cited

U.S. PATENT DOCUMENTS

| | | | | |
|---|---|---|---|---|
| 4,622,707 | A | 11/1986 | Finn | |
| D288,895 | S | 3/1987 | Sarnoff et al. | |
| 4,669,140 | A * | 6/1987 | Miceli | 7/158 |
| 4,817,221 | A | 4/1989 | Ryan | |
| 4,821,356 | A | 4/1989 | Finn | |
| D308,009 | S | 5/1990 | Evrell | |
| 5,259,281 | A | 11/1993 | Burke | |
| D369,287 | S | 4/1996 | Seber et al. | |
| 5,511,310 | A | 4/1996 | Sessions et al. | |
| D371,289 | S | 7/1996 | Huang | |
| D371,820 | S | 7/1996 | Thompson | |
| 5,596,808 | A | 1/1997 | Lake et al. | |
| 5,642,567 | A | 7/1997 | Lin | |
| 5,657,543 | A | 8/1997 | Collins | |
| D383,370 | S | 9/1997 | Chen et al. | |
| D385,471 | S | 10/1997 | Seber et al. | |
| 5,727,319 | A | 3/1998 | Myerchin et al. | |
| 5,727,325 | A | 3/1998 | Mussell | |
| D393,405 | S | 4/1998 | Seber et al. | |
| D398,211 | S | 9/1998 | Howard | |
| 6,009,581 | A | 1/2000 | Davis et al. | |
| 6,009,582 | A | 1/2000 | Harrison et al. | |
| 6,009,584 | A | 1/2000 | Padden | |
| D422,669 | S | 4/2000 | Elishewitz | |
| D425,389 | S | 5/2000 | Elishewitz | |
| 6,085,620 | A | 7/2000 | Anderson et al. | |
| D435,409 | S | 12/2000 | Roberts | |
| D442,461 | S | 5/2001 | Glesser | |
| D446,571 | S | 8/2001 | Frazer | |
| 6,318,218 | B1 | 11/2001 | Anderson et al. | |
| D452,123 | S | 12/2001 | Kelleghan | |
| 6,347,875 | B1 | 2/2002 | Painsith | |
| D473,917 | S | 4/2003 | Carter | |
| 6,574,816 | B2 | 6/2003 | Yu Chen | |
| D479,970 | S | 9/2003 | Hutchinson | |
| 6,782,576 | B1 | 8/2004 | Valencic et al. | |
| D496,425 | S | 9/2004 | Carter | |
| D497,531 | S | 10/2004 | Carter | |
| D508,194 | S | 8/2005 | Carter | |
| 6,957,466 | B2 | 10/2005 | Rivera | |
| D515,656 | S | 2/2006 | Trbovich, Jr. | |
| D519,185 | S | 4/2006 | Carter | |
| D520,825 | S | 5/2006 | Kelleghan | |
| D523,317 | S | 6/2006 | Ryan et al. | |
| D527,788 | S | 9/2006 | Kellgren | |
| D536,593 | S | 2/2007 | Fraga | |
| D553,467 | S | 10/2007 | Ryan | |
| D553,468 | S | 10/2007 | Freeman | |
| 7,302,760 | B2 | 12/2007 | Lake | |
| D563,755 | S | 3/2008 | Wu | |
| 7,337,486 | B2 | 3/2008 | Tsuda et al. | |
| 7,360,267 | B2 | 4/2008 | Quenzi | |
| 7,415,745 | B2 | 8/2008 | Rivera | |
| D599,640 | S | 9/2009 | Yang-Fu | |
| D599,641 | S | 9/2009 | Yang-Fu | |
| D600,090 | S | 9/2009 | Yang-Fu | |
| D609,992 | S | 2/2010 | Delaney | |
| 7,676,932 | B2 | 3/2010 | Grice et al. | |
| D614,933 | S | 5/2010 | Freeman | |
| D624,388 | S | 9/2010 | van Deursen | |
| 7,818,843 | B2 * | 10/2010 | Kinskey et al. | 7/105 |
| D632,154 | S | 2/2011 | Yang-Fu | |
| D634,174 | S | 3/2011 | Ryan et al. | |
| 7,913,398 | B2 | 3/2011 | Chu | |
| D639,632 | S | 6/2011 | Freeman et al. | |
| D642,888 | S | 8/2011 | Port et al. | |
| D653,520 | S | 2/2012 | Chang | |
| D654,343 | S | 2/2012 | Wu | |
| D672,841 | S | 12/2012 | Pelton | |
| D672,842 | S | 12/2012 | Pelton | |
| D675,897 | S | 2/2013 | Wu | |
| D677,551 | S | 3/2013 | Pelton | |
| D679,975 | S | 4/2013 | Pelton | |
| 8,464,382 | B2 | 6/2013 | Chu | |
| 2006/0027645 | A1 | 2/2006 | Granick | |
| 2007/0245497 | A1 | 10/2007 | Tsuda et al. | |
| 2008/0222895 | A1 | 9/2008 | Marfione et al. | |
| 2008/0271257 | A1 | 11/2008 | Frazer | |
| 2009/0000038 | A1 * | 1/2009 | Padden | 7/128 |
| 2010/0299933 | A1 | 12/2010 | Vellekamp | |
| 2012/0017443 | A1 | 1/2012 | Hao | |

OTHER PUBLICATIONS

"Microtech Troodon Double Edge OTF Knife, Beadblast Plain Edge, 138-7" BladeOps, LLC, 2 pages, retrieved on Feb. 23, 2012.

CRKT "ExiTool—Designed by Russ Kommer", Columbia River Knife & Tool Inc., 2 pages, retrieved on Feb. 23, 2012.

CRKT Columbia River Knife and Tool's Exitool 9030 Multi Tool, retrieved from http://www.amazon.com/Columbia-River-Knife-Exitool-9030/dp/B00301V8TG on Jul. 24, 2012, 6 pages.

Boker Plus Credit Card Knife 2-1/4" Blade, retrieved from http://www.Knifecenter.com on Jul. 24, 2012, 2 pages.

The Original Dog Tag Knife, Titanium Blade, Black Rubber Frame, retrieved from http://www.knifeworks.com/theoriginaldogtagknifetitaniumblade.aspx on Jul. 24, 2012, 4 pages.

Iain Sinclair, CardSharp 2, retrieved from http://iainsinclair.com/products.php on Jul. 24, 2012-07-24, 1 page.

SE MT908 11 Function Credit Card Size Survival Pocket Tool, retrieved from http://www.amazon.com/SE-MT908-Function-Credit-Survival/dp/B000Q06L14 on Jul. 24, 2012, 6 pages.

ICE Companion with Lens/Compass—Translucent, retrieved from http://www.sogshopping.com/tools/icc1-12.html?SID=pp1bedicbg7qm82okgt77lacd6 on Jul. 24, 2012, 1 page.

Survival Card w/ Fire Starter/Compass—Charcoal, retrieved from http://www.toollogic.com/tools/svc1-38.html on Jul. 24, 2012, 1 page.

DPx Hest 2.0 Knife Survival Blade, http://www.bladehq.com/item—ESEE-DPx_HEST-Folder—6996, downloaded Sep. 26, 2012.

Sheffield Moab Folding Rescue Knife, http://www.autogeek,net/sheffield-rescue-knife.html, downloaded Sep. 27, 2012.

Ontario Hest Original Fixed Blade. Downloaded from http://www.sears.com/ontario-hest-origina-fixed-blade/p-SPM6596962201?prdNo=2&bl . . . on Nov. 16, 2012.

Blackwater Aculus Limited Edition Knife. Http://www.dpxgear.com/shop/aculus-coming-soon.html, Jun. 2, 2013.

* cited by examiner

SURVIVAL KNIFE WITH INTEGRATED TOOLS

This application is a continuation-in-part of U.S. Utility patent application Ser. No. 13/312,965 filed 6 Dec. 2011, the specification of which is hereby incorporated herein by reference.

BACKGROUND OF THE INVENTION

1. Field of the Invention

One or more embodiments of the invention are related to the field of knives. More particularly, but not by way of limitation, embodiments of the invention implement a survival knife with integrated tools that may include a bottle opener/pot lifter feature, wire breaker/choil, jimping/wire strippers, hex nut driver/lashing point, pry bar/scraper, glass breaker and hidden storage area. Embodiments may be implemented as folding or non-folding and may be constructed from materials that can withstand hostile environments.

2. Description of the Related Art

Standard knives generally include a long, yet thin blade with a handle. The blade generally includes one cutting edge, and an opposing non-cutting edge. Some knives have cutting edges on both sides of the blade. Knives also are built in folding varieties and generally have a pivot on one or both ends of the handle. However, most knives are non-folding and have one cutting edge. Folding knives are generally more portable and tend to enclose the sharp cutting edge of the knife when folded for safety reasons. Some folding knives include multiple types of blades including saws, can openers, screw drivers, and other tools, but generally only provide one function per blade or only provide cutting blades that have no other function.

Hunting knives generally include thicker and hence more robust blades than standard knives and may include and cross-guards to protect the hand while cutting. Survival knives came into service during World War II and evolved during the Viet Nam war to include serrations on the top portion of the knife blade. The serrations could be used to cut through the fuselage of aircraft to rescue crewmen for example.

Modern survival knives are limited in the number of functions they provide since the number of elements utilized to create a survival knife is limited to a blade, optionally with serrations and a handle. There are no known survival knives that include a single robust blade configuration of a survival knife with structural elements on the single blade or frame such as a bottle opener/pot lifter feature, wire breaker/choil, jimping/wire strippers, hex nut driver/lashing point, pry bar/scraper, glass breaker.

Generally, survivalists and military personnel in hostile or hazardous environment carry a multitude of other tools along with a survival knife. In minimalistic survival scenarios, carrying a multitude of tools is not possible. In such hostile environments, life may depend on having a survival tool such as a knife that is robust and capable of performing other functions. For at least the limitations described above there is a need for a survival knife with integrated tools.

BRIEF SUMMARY OF THE INVENTION

One or more embodiments described in the specification are related to a survival knife with integrated tools. Embodiments of the invention include a knife blade that is highly durable with a thick top cross section. This thick top enables the blade to endure being struck when using the knife blade as a wood splitting wedge. One or more embodiments of the invention may include a non-sharpened or flat point configured for underwater use, for example to be utilized with wet suits in a manner that does not puncture the wet suit when storing the knife in a sheath along the wet suit.

An indentation on the top of the blade enables a bottle cap opener, and also enables use of the knife as a pot lifter. The indentation can also be used in combination with an indentation on the cutting edge of the blade as lashing points to enable the blade to be utilized as a spear, axe or dead drop trap when lashing the blade to a pole for example.

The indentation on the cutting edge of the blade enables a wire breaker. This indentation is also known as the wire break notch. The wire break notch is situated near the handle and also acts as a "choil" that allows sharpening for the entire blade length. The wire break notch may be aligned to indent towards the bottle cap opener indentation and visa versa so that the top and bottom indentations cooperate in the lashing configuration.

Jimping slots on the top of the blade near the handle enable thumb contact with the blade that provides better control. In addition, the jimping slots generally vary in size so that they can be used as wire strippers and for different diameters of wire insulation.

One or more hexagonal hole may be included on the blade or frame. Each hexagon hole enables the knife to be utilized as a hex nut wrench. The hexagonal hole may also be located in the center portion of the frame near the blade or in the rear portion of the frame, furthest way from the tip. Locating the hexagonal hole on the frame allows the knife to be utilized as a wrench in the open or folded configuration. In one or more embodiments, the hexagonal hole or frame may be magnetized to hold bits. If more than one hexagonal hole is implemented, then different sizes of hexagonal holes may be provided. In one or more embodiments, square or other shape holes may be provided in the blade or frame to enable the embodiments to rotate any type of nut or connector element.

Embodiments may include a hollow area in the body of the knife that may be utilized as a secret compartment when the knife is configured with one or two handle scales. For example, the hollow area enables secret or emergency storage area for money, snare wire, fire starting equipment, lighter, fishing line and hooks, bandages or any other item. The hollow area may include one or more hollow areas configured as tools, for example nut driver, e.g., hex nut drivers or castellated or slotted nut wrench(es) for example. The handle scales may be held to the knife frame with any coupling technology including screws. The storage area may be made waterproof with a bead of silicon if desired, or with any other type of sealing element.

Lashing points may also be implemented as holes in the blade or frame. Lashing points may be located anywhere on the knife as desired. Lashing points may also be implemented as holes in the blade or frame. Lashing points may be located anywhere on the knife as desired. In one or more embodiments, the lashing points may be placed anywhere on the knife blade or frame or anywhere else that does not comprise strength. In addition, the hexagonal hole(s), bottle opener, jimping slots and wire breaker may also be utilized to lash the knife frame to another object.

One or more embodiments include a projection from the frame than enables a pry bar. The pry bar may be located anywhere on the knife, including near the butt of the knife. In one embodiment, the projection points at about a right angle from the frame in the same direction as the cutting edge points with respect to the flat top of the blade. This configuration enables the rear portion of the frame to be struck to drive the pry bar into an object or between two objects to separate them. For example, the pry bar may be utilized in lieu of the blade, to split open objects, remove staples, chisel rock or ice or any other material instead of using and potentially damaging the blade. In other embodiments, the pry bar may point away from the handle or frame at any other angle. In addition, the projection may be utilized in any other manner, such as a chisel or pick or for any other purpose. Embodiments of the projection may take any shape so long as they project away from the handles or frame or spacer.

Embodiments may be utilized without the handle scales in a skeletonized manner for concealment purposes. The lashing points enable the knife to be carried with a lanyard or necklace for example. The handle scales may be removed and paracord or leather may be utilized to form a grip around the frame, wherein the material used as a grip may be tied off at the lashing points or other holes on the frame.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A survival knife with integrated tools will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
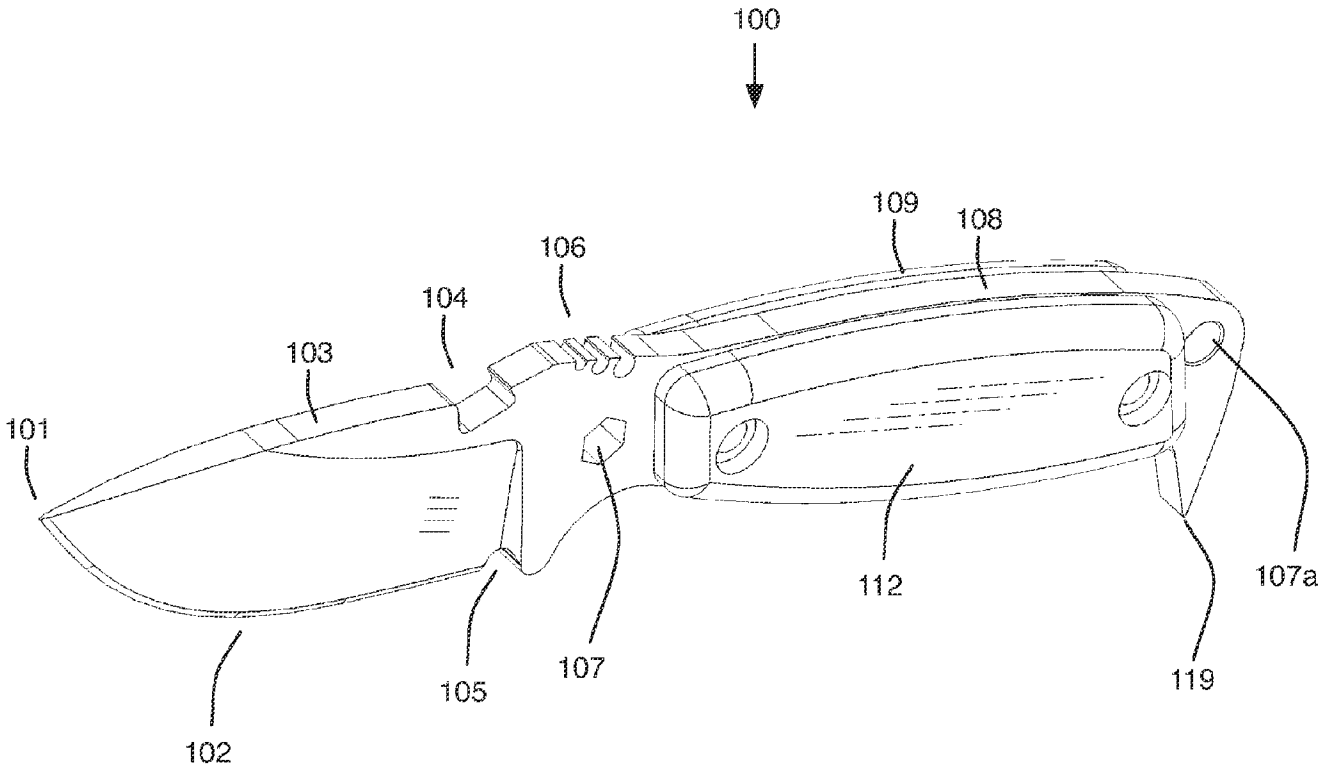
FIG. 1 illustrates a perspective left side view of an embodiment of the invention.

FIG. 1 illustrates a perspective view of an embodiment of the invention 100. The distal end of blade 101 is shown in the leftmost portion of the figure. Blade 101 has two substantially flat faces, one that is visible as shown between cutting edge 102 and non-cutting edge 103 having a flat top, the other flat face is on the opposite side of the blade and which is visible in FIG. 3. Cutting edge 102 is situated on a first side of blade 101 where the two substantially flat faces meet at the bottom portion of the blade as shown. Cutting edge 102 may also include serrated portions depending on the intended environment or application. Non-cutting edge 103 includes a flat top that is located on a second side of the blade opposite the cutting edge as shown.

Non-cutting edge 103 includes a first indentation 104 that extends toward cutting edge 102 of the blade. In one or more embodiments of the invention, indentation 104 includes a first and second wall that both slant down and back away from the distal end of the blade. The first and second wall may be any shape including linear or curved. The first and second walls meet at the inner most portion of indentation 104. The innermost portion of indentation 104 may also be liner or curved. Generally, the second wall provides a hook like area to pry a bottle cap as the first wall rests on top of the bottle cap. First indentation 104 is configured to engage a bottle cap on a top side of the bottle cap with a first portion of the first indentation, for example the left side of the indentation as shown, and also configured to engage a bottom edge of the bottle cap with an opposing side of the first indentation, for example the right side of the indentation as shown, to enable removal of the bottle cap. The depth of indentations 104 may be any depth deep enough and wide enough to remove a bottle cap. In addition, indentation 104 may also be utilized as a pot lifter wherein opposing sides of the indentation may be utilized to lift a hot pot by the handle, or on the edge of a pan to lift the pan. In one or more embodiments, the flat top at non-cutting area 103 is greater than ⅛ of an inch, or at least 3/16 of an inch wide or any other dimension thicker than a standard knife. This enables the knife to be utilized as a wedge or splitter, to split wood for example. The wide flat top may be struck with a hammer or rock for example without breaking the blade.

Cutting edge 102 generally includes a second indentation 105 configured to engage a wire to enable lateral angular movement of the blade to break the wire. Second indentation 105 is referred to as a wire breaker. Second indention 105 effectively constitutes a "choil", i.e., an unsharpened area of the knife-edge. The second indentation includes a flat portion that is not sharp in one or more embodiments, for example in the innermost portion of the indentation.

In one or more embodiments of the invention, the first indentation, i.e., bottle cap opener, and second indentation, i.e., the wire breaker are indented toward one another to enable the blade to be lashed to another object, such as a stick, with a line wrapped around the stick and within the first indentation and the second indentation. In this manner it is possible to use the knife as a spear, axe or dead drop trap.

In one or more embodiments of the invention, non-cutting edge 103 further comprises jimping 106 configured to provide a thumb grip on the non-cutting edge wherein the jimping is configured as two or more indentations of different size configured to grip wire insulation of different gauge to enable lateral translation movement of the blade to remove the wire insulation.

Embodiments of the invention include frame 108, generally shown to the right of wire breaker 105, which is coupled with the blade on a proximal end of the frame. The frame includes a distal end on an opposing end of the frame. The distal portion of the frame includes a handle area configured with two opposing flat surfaces shown at the top and bottom portions on the right side of the figure. The two opposing flat surfaces are configured to engage different portions of a human hand. Between the two opposing flat surfaces, a hollow area may be implemented (see FIG. 8) to provide a hollow area when combined with one or both handle scales 109 and 112 that include one or more hollow portions respectively. The handle scales 109 and 112 may coupled to one another using or any other coupling technique. Alternatively, the knife may be utilized without handle scales. The knife can be utilized in skeleton form, or with paracord or leather wrapped around the frame, for example around hollow area if the frame includes a hollow area. In one or more embodiments of the invention, the frame includes hexagonal hole 107 which may also be utilized as a lashing hole and lashing hole 107*a*. The lashing holes may be utilized to tie off the paracord or leather when forming such an improvised wrapping.

Hexagonal hole 107 may indent into the frame or any other portion of the knife for example that is configured to engage a hex nut to enable rotation of the frame about an axis defined by the hexagonal hole to rotate the hex nut. The hexagonal size may be of any desired dimension depending on the desired application. In one embodiment, the hexagonal hole is located between said blade and said handle area. Hexagonal hole 107 may be located as shown or optionally in place of lashing point 107*a* (see FIG. 9). In other embodiments, hexagonal hole 107 may be implemented as two different sized holes located proximally or distally from one another. In another embodiment, the hexagonal hole is located in the handle area, without lashing points, for example near a distal end of the handle area (see FIG. 9).

Figure 9:
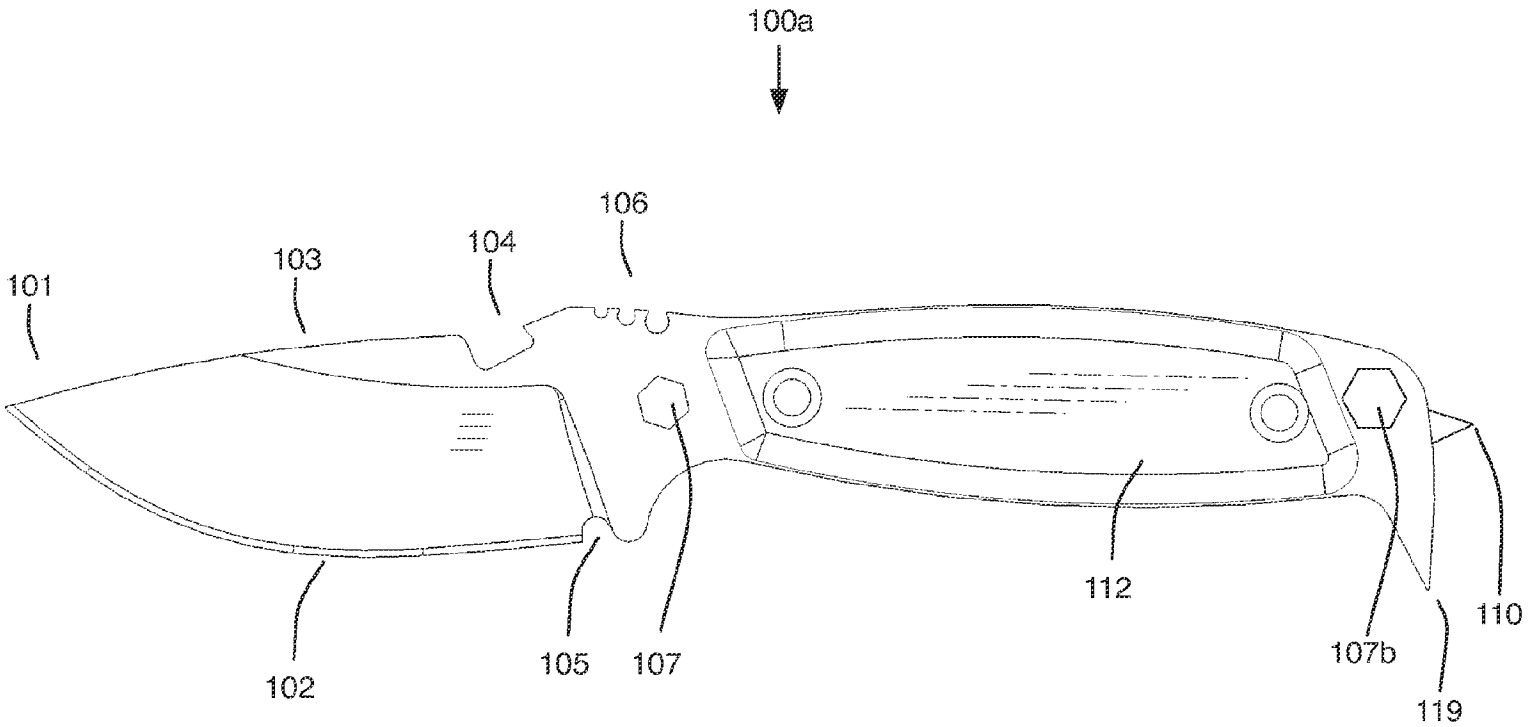
FIG. 9 illustrates an embodiment of the invention having multiple hexagonal nut drivers or lashing points and in addition includes a glass breaker.

One or more embodiments of the invention include first pointed projection 110 as shown in FIG. 9 coupled with the distal end of the frame that extends substantially parallel to the longest axis of the frame. The first pointed projection is known as a "glass breaker" and is configured break glass when struck against glass. In one or more embodiments of the invention, the glass breaker may be implemented as a conical projection that ends in a point or line or curve for example. In one or more embodiments, the first pointed projection is removably coupled to the frame.

One or more embodiments of the invention include second pointed projection 119 coupled to the frame near the distal end of the frame that extends substantially perpendicular to a longest axis of the frame. The second pointed projection is known as a "pry bar", or "chisel", or "scraper". The second pointed projection is configured to extend between two objects to enable rotation of the frame to pry the two objects apart. The second pointed projection may also be used as a chisel by providing a force to the top portion of the distal end of the frame, directly above the downward pointing second pointed projection for example.

Figure 2:
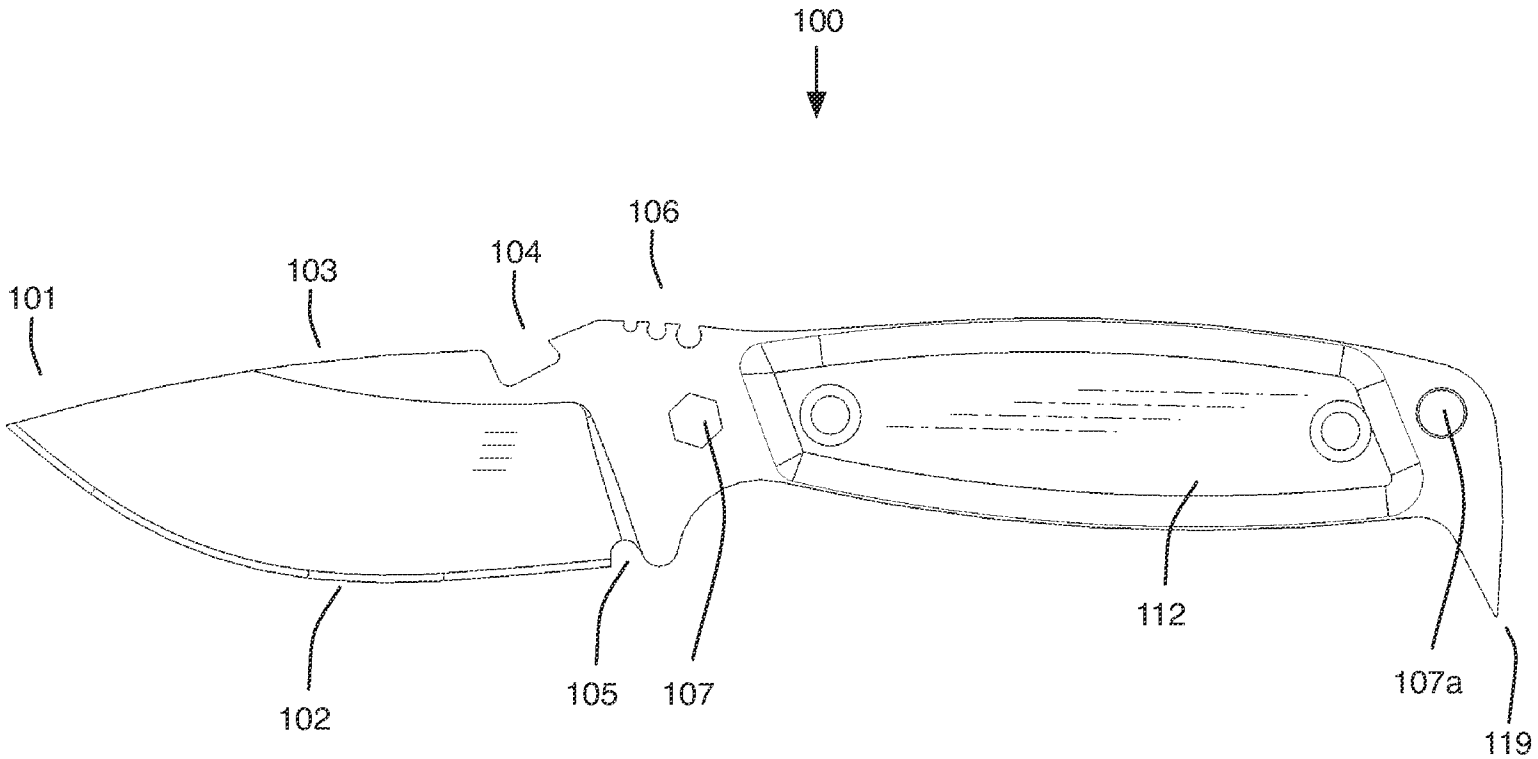
FIG. 2 illustrates a left side view of an embodiment of the invention.

FIG. 2 illustrates a left side view of an embodiment of the invention. Hexagonal hole 107 may indent entirely through the frame or partially in one direct or the other to keep a hex nut engaged within the hole.

Figure 2A:
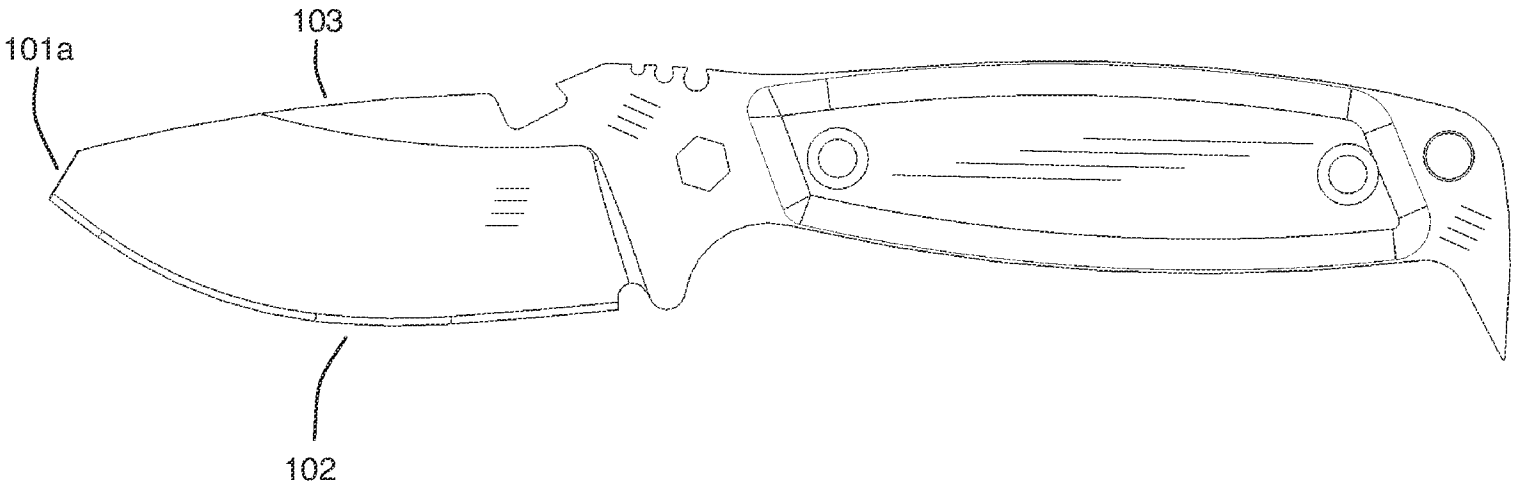
FIG. 2A illustrates a left side view of an embodiment of the invention showing an alternative flattened tip, for example configured for use in diving scenarios with wet suits.

FIG. 2A illustrates a left side view of an embodiment of the invention showing an alternative flattened tip area 101*a*, for example configured for use in diving scenarios with wet suits. In one or more embodiments the flattened tip area minimizes the chances of puncturing a wet suit when storing the knife in a sheath along side the wet suit for example.

Figure 3:
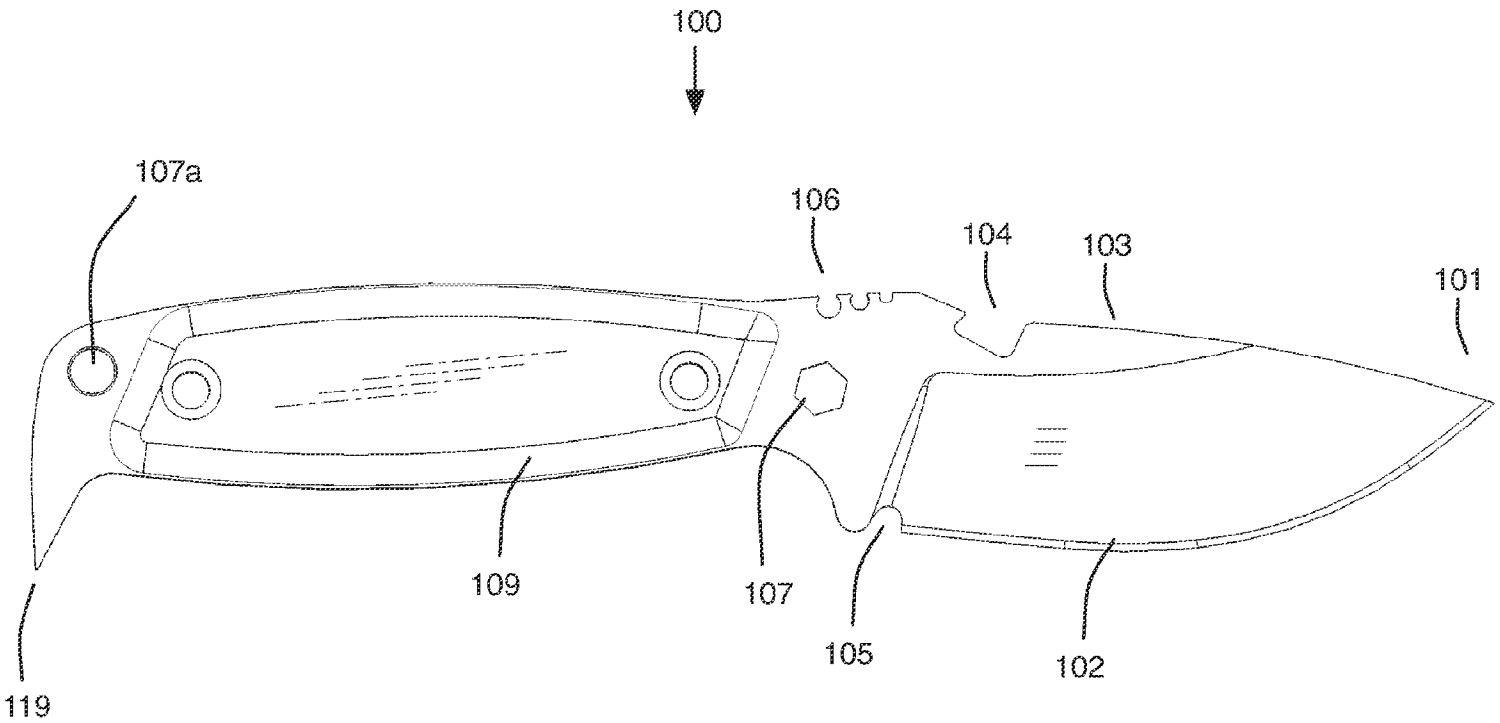
FIG. 3 illustrates a right side view of an embodiment of the invention.

FIG. 3 illustrates a right side view of an embodiment of the invention. Scale 109 is a mirror embodiment of scale 109, however scales 109 and 112 may differ in any aspect as desired.

Figure 4:
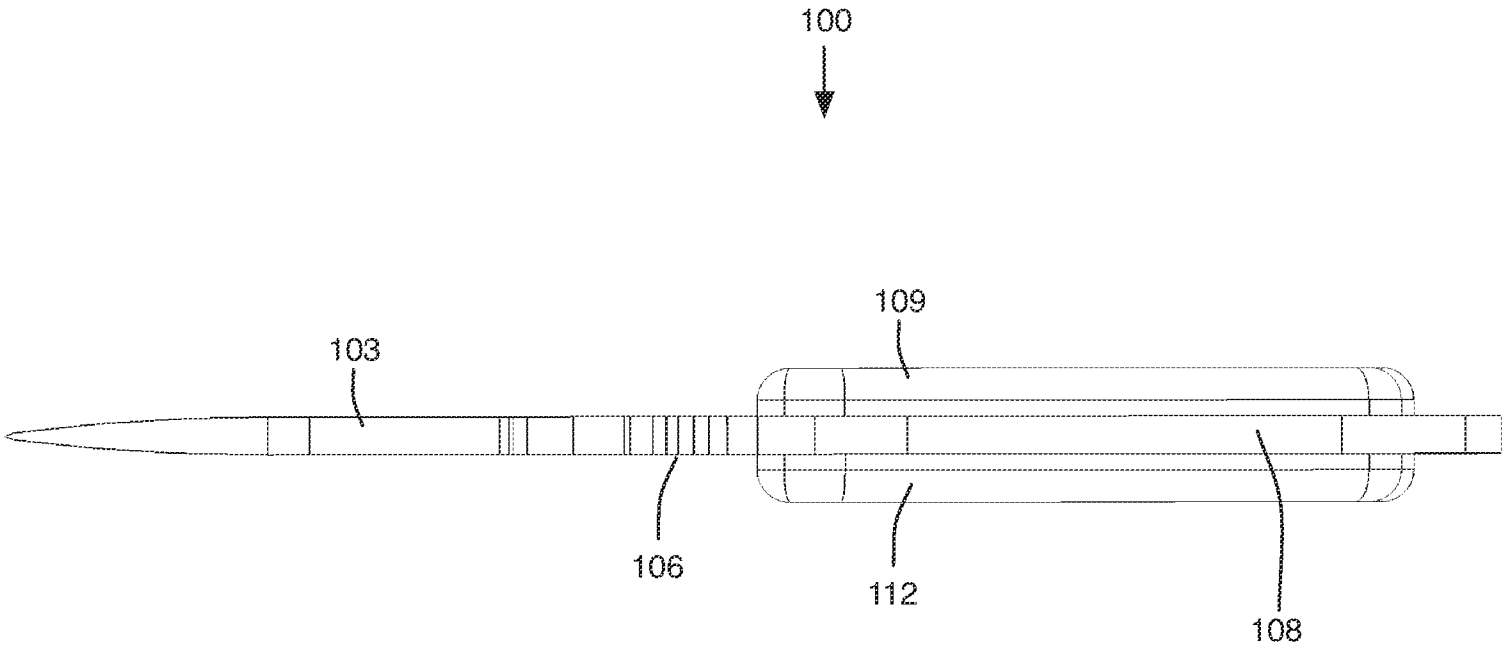
FIG. 4 illustrates a top view of an embodiment of the invention.
Figure 8:
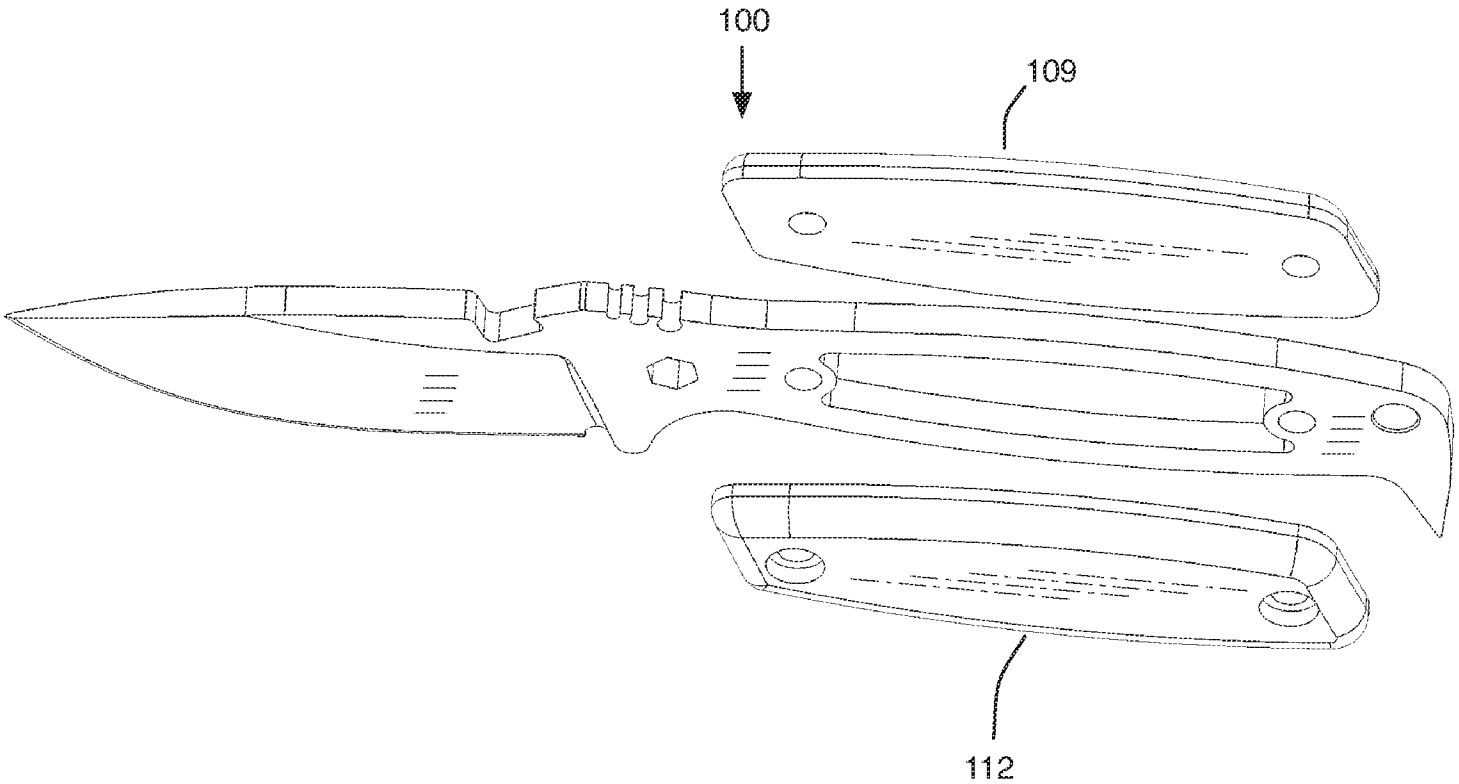
FIG. 8 illustrates a side view of an embodiment of the invention with the handle scales removed to show an embodiment of the frame.

FIG. 4 illustrates a top view of an embodiment of the invention. The width of scales 109 and 112 may be any desired size, or the scales may be removed and the knife utilized without scales as is shown in FIG. 8.

Figure 5:
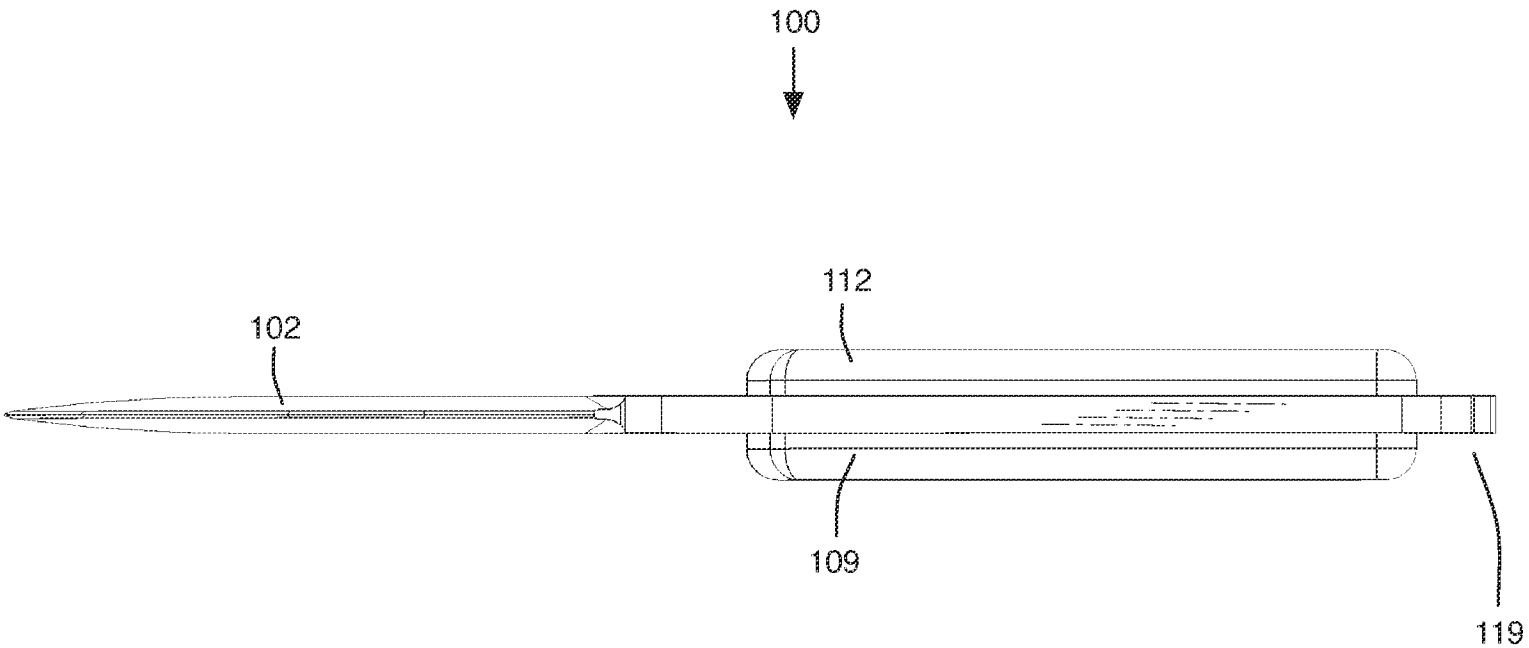
FIG. 5 illustrates a bottom view of an embodiment of the invention.

FIG. 5 illustrates a bottom view of an embodiment of the invention. The area between scales 109 and 112 is generally configured to fit the first or second knuckles of a human hand when the knife is gripped.

Figure 6:
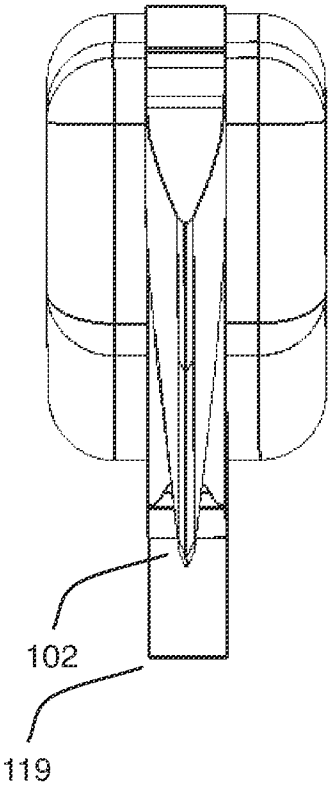
FIG. 6 illustrates a front view of an embodiment of the invention.

FIG. 6 illustrates a front view of an embodiment of the invention. Second projection 119 may extend in any direction away from the long axis of the knife parallel to the blade, including at a right angle or any other angle not parallel with the blade.

Figure 7:
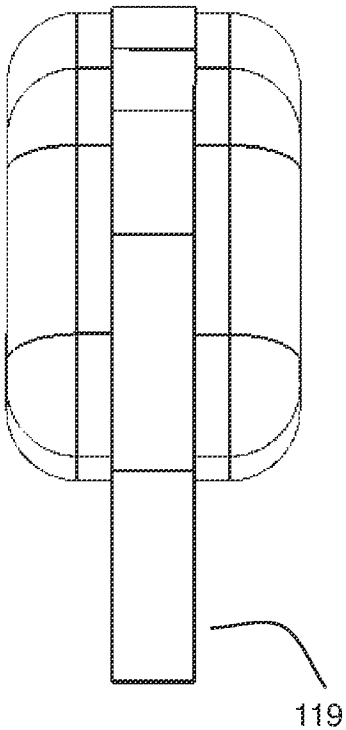
FIG. 7 illustrates a rear view of an embodiment of the invention.

FIG. 7 illustrates a rear view of an embodiment of the invention. Although second projection 119 is shown as the same thickness of the frame, second projection 119 may taper to a wider, narrower, forked or any other shape if desired.

FIG. 8 illustrates a side view of an embodiment of the invention with the handle scales removed to show an embodiment of the frame. As shown, the hollow area between scales 109 and 112 may be utilized to hide items such as money, fish hooks, or any other item that will fit within the frame and between the scales, which may also be hollowed out (not shown for brevity) if desired. Any other component of the knife may be utilized for a hidden compartment so long as the component may be formed with an internal space. The scales may be made from any type of material including wood or canvas such as MICARTA®, or fiberglass based laminates such as G10 or FR-4 or any other material as desired. Alternatively, a lightweight material in the shape of the hollow area may be inserted into the hollow area to prevent the retention of water in the hollow area if desired.

Figure 8A:
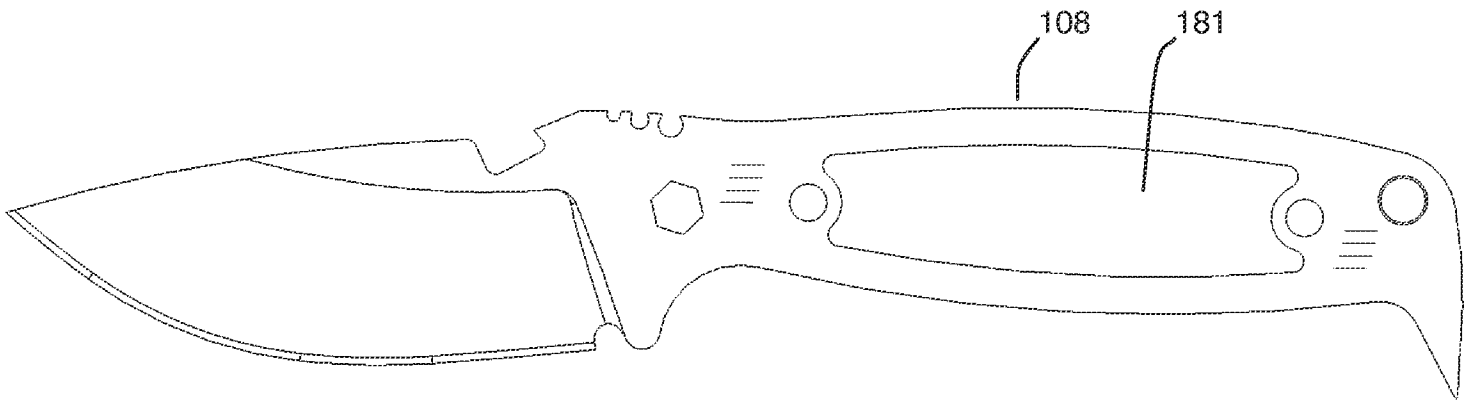
FIG. 8A illustrates an embodiment of the frame having a hollowed area.

FIG. 8A illustrates an embodiment of the frame having a hollowed area 181. This area may be utilized to store a number of items as previously described. Alternatively or in combination, the hollowed area may also include multiple hollowed areas configured as tools as shown in FIG. 8B.

Figure 8B:
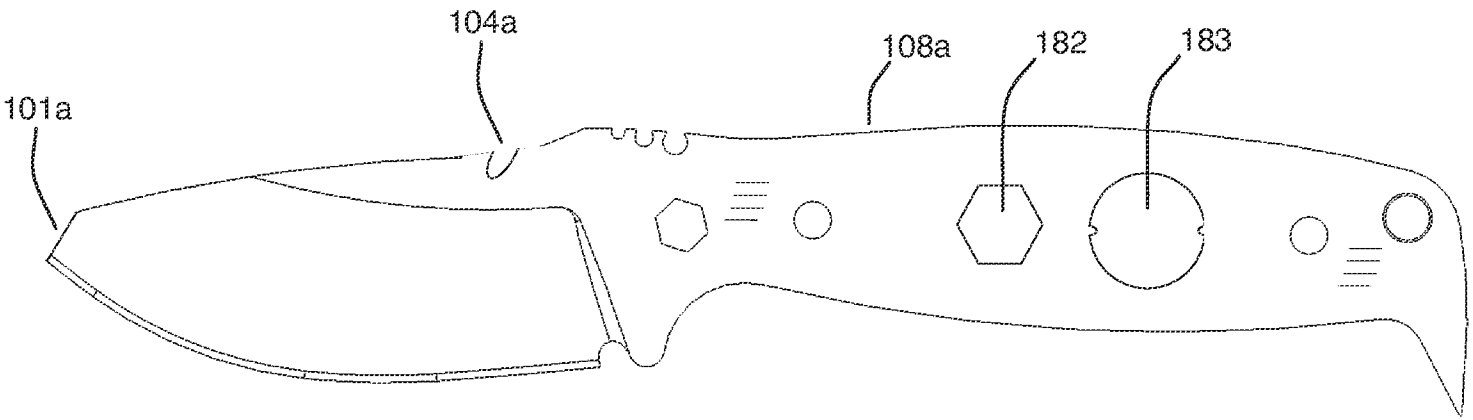
FIG. 8B illustrates an embodiment of the frame having hollowed areas configured as tools.

FIG. 8B illustrates an embodiment of the frame having hollowed areas configured as tools. As shown, hex nut driver 182 and castellated or slotted nut wrench or wrenches 183 may be included as hollow areas that either extend through the entire frame or partially through the frame if desired to provide a stopping point for the frame when engaged with an item to turn. These types of tools or any other desired tools may be configured as hollow areas in the frame depending on the desired functionality. Indentation 104*a* may be utilized as previously described as a bottle cap opener and/or as a wire/rope cutter or gut hook in the furthermost portion of the indentation is sharpened. When implemented as a cutter or gut hook, indentation 104*a* may be indented in a forward downward direction as shown for example or in any other direction. Indentation 104*a* may be of any size as desired for the particular intended application.

FIG. 9 illustrates an embodiment of the invention 100*a* having multiple hexagonal holes 107 and 107*b* of different size that are utilized as hexagonal nut drivers or lashing points and in addition includes glass breaker 110. Glass breaker 110 may be integrally formed into the frame or may screw in for replacement if desired.

Embodiments may be constructed from any type of rugged material for the blade, frame and optional handles. Embodiment may be implemented with a blade made from 1095 Carbon steel, or Milspec black coated D2 tool steel or SLEIPNER® tool steel, Niolox, ELMAX®, or any other material having a flat top thickness of greater than 0.1 inches, optionally 3/16 of an inche or nearly 0.2 inches or more and 3 inch cutting edge or in any other dimensions. In this embodiment, the knife weighs about 5 ounces and has a full length of 7.7 inches. Other embodiments, may utilize titanium, beta titanium, layered titanium for the frame or other components or any other material depending on the intended application.

While the invention herein disclosed has been described by means of specific embodiments and applications thereof, numerous modifications and variations could be made thereto by those skilled in the art without departing from the scope of the invention set forth in the claims.

What is claimed is:

1. A survival knife with integrated tools comprising:

a blade having two substantially flat faces and a flat top, wherein the blade comprises a cutting edge on a first side of the blade where the two substantially flat faces meet and a non-cutting edge defined by the flat top that is located on a second side of the blade opposite the cutting edge;

wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the cutting edge comprises a second indentation configured to engage a wire to enable lateral angular movement of the blade to break the wire;

wherein the first indentation and second indentation are indented toward one another to enable said blade to be lashed to another object with a line wrapped around said other object and said first indentation and said second indentation;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation; and, a frame coupled with the blade on a proximal end of the frame and having a distal end of the frame on an opposing end of the frame, wherein the frame comprises a handle area configured with two opposing flat surfaces configured to engage different portions of a human hand.

2. The survival knife with integrated tools of claim 1 wherein said frame further comprises a hexagonal hole through the frame that is configured to engage a hex nut to enable rotation of the frame about an axis defined by the hexagonal hole to rotate the hex nut.

3. The survival knife with integrated tools of claim 1 wherein said frame further comprises a first pointed projection coupled with the distal end of the frame that extends substantially parallel to the longest axis of the frame and that is configured break glass.

4. The survival knife with integrated tools of claim 1 wherein said frame further comprises a second pointed projection coupled to the frame near the distal end of the frame that extends substantially perpendicular to a longest axis of the frame and that is configured to extend between two objects to enable rotation of the frame to pry the two objects apart.

5. The survival knife with integrated tools of claim 1 wherein said flat top is at least 3/16 of an inch wide.

6. The survival knife with integrated tools of claim 1 further comprising scales wherein said frame defines a hollow area on an interior portion of said frame configured to hold items between said scales.

7. The survival knife with integrated tools of claim 1 wherein said frame comprises at least one hollow area on an interior portion of said frame configured as a tool.

8. The survival knife with integrated tools of claim 1 wherein said blade comprises a flattened tip.

9. A survival knife with integrated tools comprising:

a blade having two substantially flat faces and a flat top, wherein the blade comprises a cutting edge on a first side of the blade where the two substantially flat faces meet and a non-cutting edge defined by the flat top that is located on a second side of the blade opposite the cutting edge;

wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the cutting edge comprises a second indentation configured to engage a wire to enable lateral angular movement of the blade to break the wire;

wherein the first indentation and second indentation are indented toward one another to enable said blade to be lashed to another object with a line wrapped around said other object and said first indentation and said second indentation;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation;

a frame coupled with the blade on a proximal end of the frame and having a distal end of the frame on an opposing end of the frame, wherein the frame comprises a handle area configured with two opposing flat surfaces configured to engage different portions of a human hand; and, a hexagonal hole through the frame that is configured to engage a hex nut to enable rotation of the frame about an axis defined by the hexagonal hole to rotate the hex nut.

10. The survival knife with integrated tools of claim 9 wherein said frame further comprises a first pointed projection coupled with the distal end of the frame that extends substantially parallel to the longest axis of the frame and that is configured break glass.

11. The survival knife with integrated tools of claim 9 wherein said frame further comprises a second pointed projection coupled to the frame near the distal end of the frame that extends substantially perpendicular to a longest axis of the frame and that is configured to extend between two objects to enable rotation of the frame to pry the two objects apart.

12. The survival knife with integrated tools of claim 9 wherein said flat top is at least 3/16 of an inch wide.

13. The survival knife with integrated tools of claim 9 further comprising scales wherein said frame defines a hollow area on an interior portion of said frame configured to hold items between said scales.

14. The survival knife with integrated tools of claim 9 wherein said frame comprises at least one hollow area on an interior portion of said frame configured as a tool.

15. The survival knife with integrated tools of claim 9 wherein said blade comprises a flattened tip.

16. A survival knife with integrated tools comprising:

a blade having two substantially flat faces and a flat top, wherein the blade comprises a cutting edge on a first side of the blade where the two substantially flat faces meet and a non-cutting edge defined by the flat top that is located on a second side of the blade opposite the cutting edge;

wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation; and, a frame coupled with the blade on a proximal end of the frame and having a distal end of the frame on an opposing end of the frame, wherein the frame comprises a handle area configured with two opposing flat surfaces configured to engage different portions of a human hand.

17. The survival knife with integrated tools of claim 16 wherein said frame further comprises a hexagonal hole through the frame that is configured to engage a hex nut to enable rotation of the frame about an axis defined by the hexagonal hole to rotate the hex nut.

18. The survival knife with integrated tools of claim 16 wherein said frame further comprises a first pointed projection coupled with the distal end of the frame that extends substantially parallel to the longest axis of the frame and that is configured break glass.

19. The survival knife with integrated tools of claim 16 wherein said frame further comprises a second pointed projection coupled to the frame near the distal end of the frame that extends substantially perpendicular to a longest axis of the frame and that is configured to extend between two objects to enable rotation of the frame to pry the two objects apart.

20. The survival knife with integrated tools of claim 16 wherein said flat top is at least 3/16 of an inch wide.

21. The survival knife with integrated tools of claim 16 wherein said frame comprises at least one hollow area on an interior portion of said frame configured as a tool.

22. The survival knife with integrated tools of claim 16 wherein said blade comprises a flattened tip.

23. A survival knife with integrated tools comprising:

a blade having two substantially flat faces and a flat-top top, wherein the blade comprises a cutting edge on a first side of the blade where the two substantially flat faces meet and a non-cutting edge defined by the flat top that is located on a second side of the blade opposite the cutting edge;

wherein the non-cutting edge further comprises jimping configured to provide a thumb grip on the non-cutting edge wherein the jimping is configured as two or more indentations of different size configured to grip wire insulation of different gauge to enable lateral translation movement of the blade to remove the wire insulation; and, a frame coupled with the blade on a proximal end of the frame and having a distal end of the frame on an opposing end of the frame.

24. The survival knife with integrated tools of claim 23 wherein said frame is further coupled with a first pointed projection that extends from an end of the handle on an opposite end with respect to said blade wherein the first pointed projection is configured to break glass.

25. The survival knife with integrated tools of claim 23 wherein said frame further comprises a second pointed projection coupled to the frame near the distal end of the frame that extends substantially perpendicular to a longest axis of the frame and that is configured to extend between two objects to enable rotation of the frame to pry the two objects apart.

26. The survival knife with integrated tools of claim 23, wherein the non-cutting edge comprises an first indentation toward the cutting edge of the blade that is configured to engage a bottle cap on a top side of the bottle cap with a first portion of the first indentation and configured to engage a bottom edge of the bottle cap with an opposing side of the first indentation to enable removal of the bottle cap;

wherein the cutting edge comprises a second indentation configured to engage a wire to enable lateral angular movement of the blade to break the wire; and, wherein the first indentation and second indentation are indented toward one another to enable said blade to be lashed to another object with a line wrapped around said other object and said first indentation and said second indentation.

27. The survival knife with integrated tools of claim 23 wherein said frame comprises at least one hollow area on an interior portion of said frame configured as a tool.

28. The survival knife with integrated tools of claim 23 wherein said blade comprises a flattened tip.

* * * * *